US010154338B2

(12) United States Patent
Strange et al.

(10) Patent No.: US 10,154,338 B2
(45) Date of Patent: Dec. 11, 2018

(54) LOUDSPEAKER SYSTEM WITH TRANSDUCER ARRAY

(71) Applicant: Core Brands, LLC, Petaluma, CA (US)

(72) Inventors: Michael L. Strange, Petaluma, CA (US); Doug S. Wright, Coeur d'Alene, ID (US); Vance Dickason, Lake Oswego, OR (US)

(73) Assignee: Core Brands, LLC, Petaluma, CA (US)

( * ) Notice: Subject to any disclaimer, the term of this patent is extended or adjusted under 35 U.S.C. 154(b) by 0 days.

(21) Appl. No.: 15/823,107

(22) Filed: Nov. 27, 2017

(65) Prior Publication Data

US 2018/0084335 A1 Mar. 22, 2018

Related U.S. Application Data

(63) Continuation of application No. 15/308,536, filed as application No. PCT/US2015/028824 on May 1, 2015, now Pat. No. 9,860,630.

(60) Provisional application No. 61/987,586, filed on May 2, 2014.

(51) Int. Cl.

| | |
|---|---|
| ***H04R 1/20*** | (2006.01) |
| ***H04R 1/28*** | (2006.01) |
| ***H04R 1/26*** | (2006.01) |
| ***H04R 1/02*** | (2006.01) |

(52) U.S. Cl.

CPC ..... *H04R 1/2896* (2013.01); *H04R 1/026* (2013.01); *H04R 1/26* (2013.01); *H04R 2201/021* (2013.01)

(58) Field of Classification Search

CPC ..... H04R 1/026; H04R 1/26; H04R 1/2896; H04R 2201/021

See application file for complete search history.

(56) References Cited

U.S. PATENT DOCUMENTS

| | | | | |
|---|---|---|---|---|
| 4,072,829 A | | 2/1978 | Ogihara | |
| 4,122,315 A | * | 10/1978 | Schroeder | H04R 1/24 381/186 |
| 6,101,262 A | * | 8/2000 | Haase | H04R 1/24 381/386 |
| 6,683,963 B2 | | 1/2004 | Sterns et al. | |
| 7,032,708 B2 | | 4/2006 | Popken et al. | |

(Continued)

FOREIGN PATENT DOCUMENTS

| | | |
|---|---|---|
| EP | 1617128 A2 | 1/2006 |
| GB | 2439436 A | 12/2007 |

(Continued)

OTHER PUBLICATIONS

"U.S. Appl. No. 15/308,536, Notice of Allowance dated Sep. 13, 2017", 10 pgs.

(Continued)

*Primary Examiner* — Brian Ensey

(74) *Attorney, Agent, or Firm* — Schwegman Lundberg & Woessner, P.A.

(57) ABSTRACT

In an example, a loudspeaker system includes a low frequency first transducer and an array of high frequency transducers overlapping a front face of the low frequency transducer. In an example, the transducer array has an arcuate profile, and an axis of the array is non-coaxial with a central axis of the first transducer.

20 Claims, 8 Drawing Sheets

(56) References Cited

U.S. PATENT DOCUMENTS

| | | | | |
|---|---|---|---|---|
| 7,325,648 | B2 | 2/2008 | Sasaki et al. | |
| 7,731,130 | B2 | 6/2010 | Decanio et al. | |
| 8,027,493 | B2 | 9/2011 | Levitsky | |
| 8,189,823 | B2 | 5/2012 | Tezuka et al. | |
| 8,229,155 | B2 | 7/2012 | Maurer et al. | |
| 8,485,487 | B2 | 7/2013 | Cheng | |
| 9,860,630 | B2 | 1/2018 | Strange et al. | |
| 2003/0142844 | A1 | 7/2003 | Rivera | |
| 2005/0175211 | A1 | 8/2005 | Suzuki | |
| 2007/0121988 | A1 | 5/2007 | Merrey | |
| 2008/0308705 | A1 | 12/2008 | Sharp et al. | |
| 2010/0027827 | A1* | 2/2010 | Tezuka ..... | H04R 1/24 381/340 |
| 2013/0034251 | A1 | 2/2013 | Fincham | |
| 2013/0251181 | A1 | 9/2013 | Stewart, Jr. et al. | |
| 2014/0270304 | A1 | 9/2014 | Pieklik et al. | |
| 2017/0099542 | A1 | 4/2017 | Strange et al. | |

FOREIGN PATENT DOCUMENTS

| | | | |
|---|---|---|---|
| WO | WO-8602508 | A1 | 4/1986 |
| WO | WO-0041434 | A2 | 7/2000 |
| WO | WO-2015168577 | A1 | 11/2015 |

OTHER PUBLICATIONS

"Atlas Sound FAPSUB 8", [Online] retrieved from the internet: URL:http://gmyngbs.blogspot.nl/2O12/02/sale-sound-fapsub-8-subwoofer-system.html, (Feb. 1, 2012).

"Avsforum", [Online] retrieved from the internet: <URL:http://www.avsforum.ers/1425121-meet-world-s-dumbest-most-expe om/forum/89-speakers/1425121-meet-world-s-dumbest-most-expensive-speaker-4-7-mi11ion-hart-audioa-s-d-w-aural-pieasure-loudspeaker.html-E>, (Aug. 18, 2012).

"FAPSUB Subwoofer System", [Online] retrieved from the internet: URL:http://www.atlassound.eom/v/SupportFiles/2240/FAPSUB_RevBData.pdf, (Feb. 1, 2012).

"IC 610 SUR FG Jamo Speaker review, pros & cons, specification and IC 610 SUR FG Jamo Speaker PDF user manual & guide download › omrid.com", [Online] retrieved from the Internet: <URL:http://www.omrid.com/ic-610-sur-fg-jamo-speaker-131503/>, (Nov. 28, 2013).

"iC3 ARC Our Best Mid-Size Ceiling Speaker", [Online]. Retrieved from the Internet: <URL: http://www.nilesaudio.com/docs/productSheets/CS0323A-CM7FX-V6.pdf, (2013), 2 pgs.

"International Application Serial No. PCT/US2015/028824, International Preliminary Report on Patentability dated Sep. 5, 2016", 9 pgs.

"International Application Serial No. PCT/US2015/028824, International Search Report dated Sep. 25, 2015", 8 pgs.

"International Application Serial No. PCT/US2015/028824, Invitation to Pay Additional Fees and Partial Search Report dated Jul. 16, 2015", 24 pgs.

"International Application Serial No. PCT/US2015/028824, Written Opinion dated Sep. 25, 2015", 12 pgs.

"Jamo : 600 Custom Series : IC610SUR", [Online] retrieved from the internet: <URL:http://www.jamo.com/speaker-lines/custom/60O/?sku=IC610SUR>, (Nov. 28, 2013).

"Jamo : Custom 200 Series : IC206LCRFG", [Online] retrieved from the internet: <URL:https://web.archive.org/web/20140309080048/http://www.jamo.com/speaker-lines/custom/2O0/?sku=IC206LCRFG>, (Mar. 9, 2014).

"Jamo : Installation Speakers : IC610LCR", [Online] retrieved from the internet: <URL:https ://web.archi ve.org/web/20131026232839/http://www.jamo.com/custom-installaton/installation-speakers/?sku=IC610LCR>, (Oct. 26, 2013).

"NHT iC4 ARC In-Ceiling Loudspeaker Installation Guide In-Ceiling Loudspeaker Installation Guide", NHT Installation Guide, (Aug. 16, 2013).

"NHT iC4-ARC In-Ceiling Speaker", [Online] retrieved from the internet: <URL:http://www.nhthifi.com/iC4-ARC-In-Ceil>, (Aug. 1, 2013).

"Pro Class Architectural Speakers", [Online]. Retrieved from the Internet: <URL: http://www.nxgtechnology.com/speakers.html, (Apr. 28, 2014), 5 pgs.

"Surround Effects Loudspeaker Specification Sheet", [Online]. Retrieved from the Internet: <URL: http://www.nhthifi.com/site/pdf/iC3-ARC_Brochure_Final.pdf, (2011), 2 pgs.

* cited by examiner

LOUDSPEAKER SYSTEM WITH TRANSDUCER ARRAY

CLAIM OF PRIORITY

This patent application is a continuation of U.S. patent application Ser. No. 15/308,536, entitled "VIBRATION DAMPING AND MOUNTING ASSEMBLY FOR A LOUDSPEAKER," filed on Nov. 2, 2016, which is a U.S. National Stage Filing Under 35 U.S.C. § 371 of International Patent Application Serial No. PCT/US2015/028824, entitled "VIBRATION DAMPING AND MOUNTING ASSEMBLY FOR A LOUDSPEAKER," filed on May 1, 2015, and published on Nov. 5, 2015, as WO 2015/168577 A1, which claims the benefit of priority to U.S. Provisional Patent Application No. 61/987,586, entitled "FLUSH-MOUNTED VIBRATION-ISOLATING IN-CEILING LOUDSPEAKER SYSTEM WITH HIGH FREQUENCY TRANSDUCER ARRAY," filed on May 2, 2014, which is hereby incorporated by reference herein in its entirety.

BACKGROUND

A stand-alone loudspeaker system can include one or more transducers in a cabinet or box. The cabinet is often constructed using a heavy duty, high-density material to provide a rigid or stiff cabinet structure that isolates a transducer's front-propagating acoustic wave signal from its rear-propagating wave signal. Among other benefits, a rigid cabinet can resist rear-wave transmission of low frequency energy or vibration, and can help to prevent second-order low frequency signal propagation that can degrade system performance. In addition, a rigid or stiff cabinet can improve a low frequency transducer's effectiveness by helping to focus the transducer's energy into a listening space.

As cabinet rigidity or stiffness is decreased, more low frequency energy can be lost in excitation or pumping of the cabinet. Such excitation of a cabinet can result in the cabinet itself acting as a transducer, leading to signal degradation and fidelity loss, such as due to second-order low frequency signal propagation, or due to phase cancellation. When a cabinet is a stand-alone box, the cabinet generally has limited influence on other environmental structures or elements, such as a floor upon which the cabinet sits. Typically, a floor is made of a relatively strong, stiff material, thus minimizing transmission of any vibrations from a loudspeaker to the mechanical structure of the surrounding environment.

Flush-mounted, in-wall or in-ceiling loudspeaker systems present different performance challenges and design compromises as compared to stand-alone cabinet-type loudspeaker systems. For example, due to size or other constraints, some flush-mounted in-wall or in-ceiling loudspeakers may not include a sufficient rear-wave containment structure to prevent unwanted signal propagation or to help focus the loudspeaker's energy.

In-wall or in-ceiling loudspeaker systems can be mounted to surfaces that are fabricated from lightweight materials, such as drywall. In comparison to materials used in stand-alone cabinet-type loudspeaker systems, such wall and ceiling materials can be prone to mechanical excitement. Thus, vibration or sound, such as generated by a loudspeaker that is mounted to a wall or ceiling in one portion of a building structure, can be unintentionally transmitted into other areas of the building structure, such as into adjoining rooms.

Some loudspeaker systems include multiple transducers. For example, a loudspeaker system can include a low frequency transducer and a coaxial high frequency transducer. To help compensate for a low frequency transducer's inherently poor mid frequency off-axis response or directivity, some systems that include a relatively large low frequency transducer (e.g., 8" or greater) can include mid and high frequency transducers to improve the system's off-axis frequency response or directivity. In some examples, multiple high frequency transducers can be used, and each of the high frequency transducers can be responsible for reproducing a specified frequency band.

Deploying multiple high frequency transducers in close proximity to one another can disrupt the transducers' intrinsically wide and smooth off-axis response. However, positioning the multiple transducers together in an array, such as along a single line, can minimize disruption to the horizontal off-axis frequency response. The frequency response along the transducer's vertical axis of alignment may be diminished, however, due to the close proximity of the transducers. As a result, such systems can exhibit relatively wide horizontal directivity and relatively narrow vertical directivity. The heightened vertical directivity tends to diminish reflections on the floor and ceiling of a room and is thought to enhance speech intelligibility.

OVERVIEW

The present inventors have recognized that a problem to be solved can include minimizing energy transmission from an in-wall or in-ceiling loudspeaker system to a building structure in which the loudspeaker system is installed. The present inventors have recognized that a further problem to be solved can include minimizing second-order low frequency signal propagation in in-wall or in-ceiling loudspeaker systems. The present subject matter can help provide a solution to these problems, such as by providing a mechanical damping arrangement to isolate acoustic vibration of a loudspeaker system from a building structure to which the loudspeaker system is mounted or coupled.

In an example, the present subject matter includes one or more mechanical dampers that absorb vibration by substantially decoupling the loudspeaker transducer from the building structure, such as without degrading an integrity or security of the loudspeaker system's frame, or other physical attachment means, to the building structure, and without degrading the integrity of an air-tight seal between the loudspeaker system and the building structure or wall surface.

In some examples, a loudspeaker system includes two or more drivers or transducers, for example, a woofer for reproducing low frequencies, and a tweeter for reproducing high frequencies. In some examples, the tweeter is positioned in front of, or above, the woofer's diaphragm or cone. The tweeter can be coaxial with the woofer's cone, or the tweeter can be offset from the woofer's axis. In some examples, a second tweeter or a mid-range woofer is additionally or alternatively positioned in front of, or above, the cone of the low frequency woofer. In some examples, an array of high frequency transducers can be positioned in front of a low frequency woofer's cone.

The present inventors have recognized that a problem to be solved can include providing a wide soundfield across audible frequencies in both vertical and horizontal directions. The present subject matter can help provide a solution to this problem, for example, by using an adjustable array of high frequency transducers. The present inventors have recognized that given the dispersion compromise along at least one axis due to multiple, line-oriented, high frequency transducers, it can be helpful to align a transducer array to an axis that is selected for a particular application. For example, when the application includes sound reproduction for the consumption of human beings seated in a stadium-style auditorium, then the axis of the transducer array can be aligned in a first direction. When the application includes sound reproduction for the consumption of human beings standing on a level surface, then the axis of the transducer array can be aligned in a second direction. Humans are generally adept at locating a direction from which sound propagates in the horizontal axis, but are generally not as adept at locating the direction from which the same sound propagates in the vertical axis. Therefore, designers can maximize the perceived fidelity by maximizing the loudspeaker response along the horizontal axis, such as by orienting a line array of high frequency transducers along the vertical axis. In an example, the present subject matter includes a loudspeaker system with an array of high frequency transducers that are adjustable by a user and that can pivot or rotate into a user-specified orientation, such as to improve the perceived fidelity given a particular installation environment or a particular listener's acoustic preference.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the claims, the terms "including" and "comprising" are open-ended, that is, a system, device, article, composition, formulation, or process that includes elements in addition to those listed after such a term in a claim are still deemed to fall within the scope of that claim. Moreover, in the claims, the terms "first," "second," and "third," etc. are used merely as labels, and are not intended to impose numerical requirements on their objects.

Figure 1:
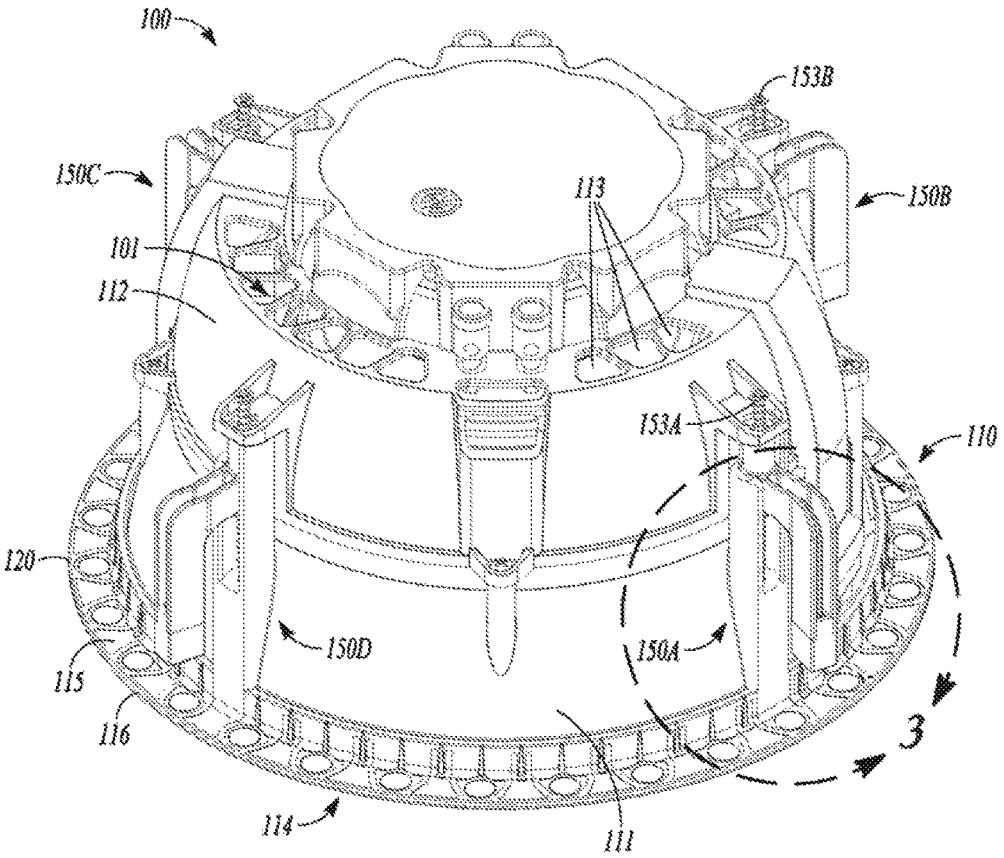
FIG. 1 illustrates generally an isometric view of a loudspeaker system with a vibration damping assembly.

FIG. 1 illustrates generally an isometric view of a mountable first loudspeaker system 100 with a vibration damper. The vibration damper can include one or more of a flange damper, clamp damper, or a peripheral frame-edge damper, such as can be used to damp vibrational energy in multiple axes.

The first loudspeaker system 100 can include one or more loudspeaker transducers, such as a woofer assembly 101 for reproducing low frequency energy, and one or more other transducers for reproducing mid or high frequency energy. The first loudspeaker system 100 is configured to be substantially flush-mounted with a mounting surface such as a wall, ceiling, cabinet, or other rigid surface. The loudspeaker system 100 of FIG. 1, among other examples illustrated herein, is shown as including a circular profile, however, other loudspeaker system shapes can be similarly used or configured for use with a damper system as described herein.

The first loudspeaker system 100 includes a mounting frame 110. The mounting frame 110 includes a rear cup portion 112 having an opening that is configured to mate with a front frame portion 111. The front frame portion 111 includes an open front face 114, such as corresponding to the front or sound-projecting face of the woofer assembly 101. In the example of FIG. 1, the sides and rear of the woofer assembly 101 are substantially enclosed by the rear cup portion 112 and by the front frame portion 111 of the mounting frame 110. The rear cup portion 112 can be substantially closed, or sealed, or the rear cup portion 112 can include one or more ports 113. The one or more ports 113 can provide fluid communication between a cavity airspace in which the first loudspeaker system 100 is mounted and an area behind the one or more loudspeaker transducers in the first loudspeaker system 100.

Figure 5:
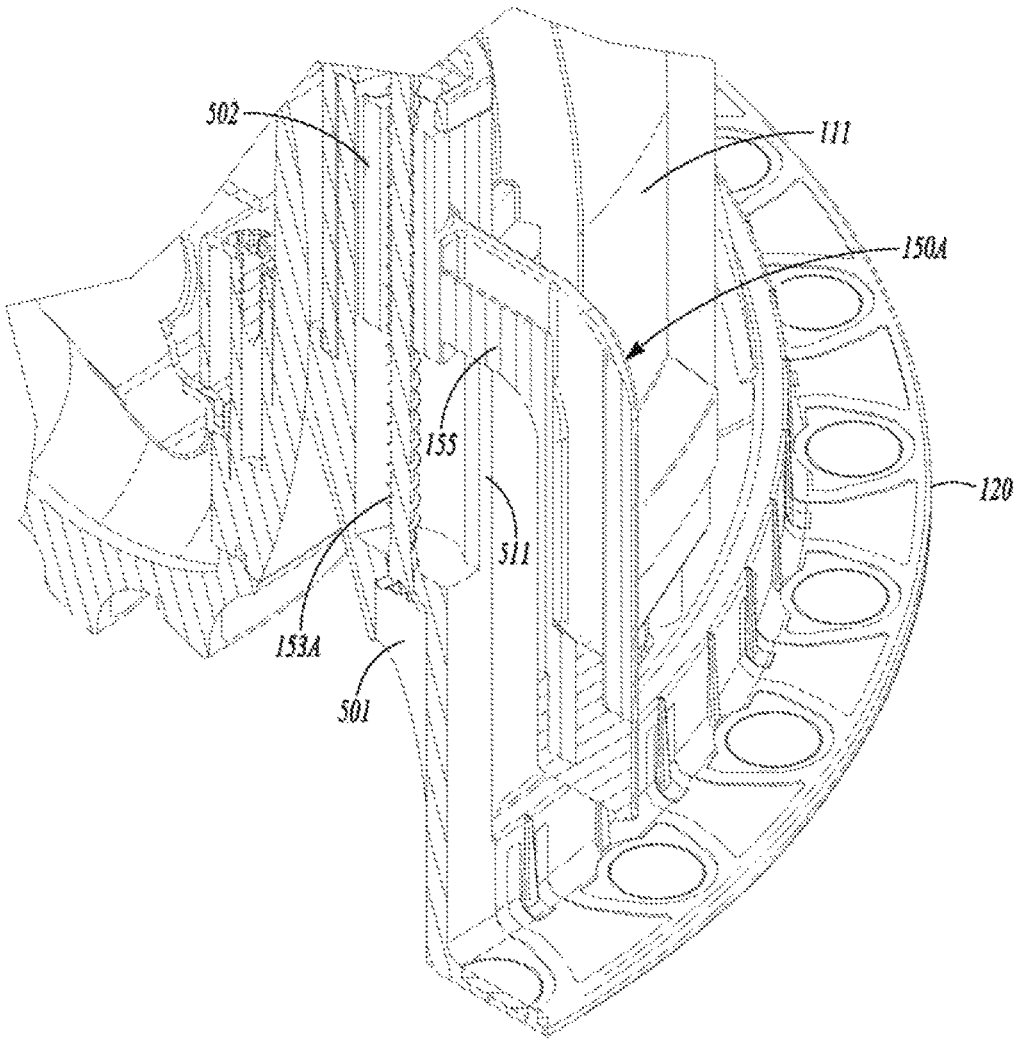
FIG. 5 illustrates generally a first isometric section view of a loudspeaker system and clamp screw.
Figure 6:
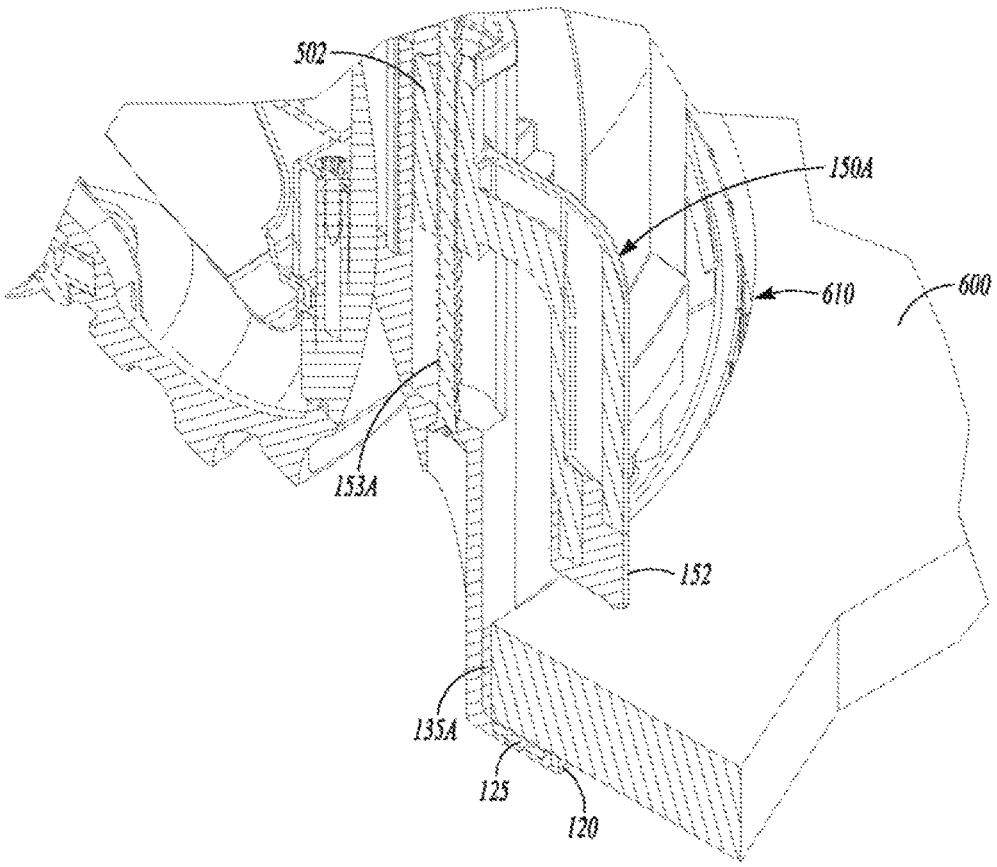
FIG. 6 illustrates generally a second isometric section view of an in-ceiling loudspeaker system with a vibration damping assembly and a mounting surface.

The front frame portion 111 can include a flange 120 that extends around all or a portion of the open front face 114. That is, a perimeter edge of the open front face 114 can include the flange 120 as a continuous member that extends laterally or radially outward from the perimeter edge and terminates at an outer edge 116. The first loudspeaker system 100 can be mounted against a wall, ceiling, or other target mounting surface, by positioning a substantially planar inner surface 115 of the flange 120 against a planar outer surface of the target mounting surface. The flange 120 thus includes a transducer-facing side corresponding to the substantially planar inner surface 115, and the flange 120 includes an opposite room-facing side. FIGS. 5 and 6, described below, further illustrate coupling the flange 120 with a target mounting surface.

Figure 2:
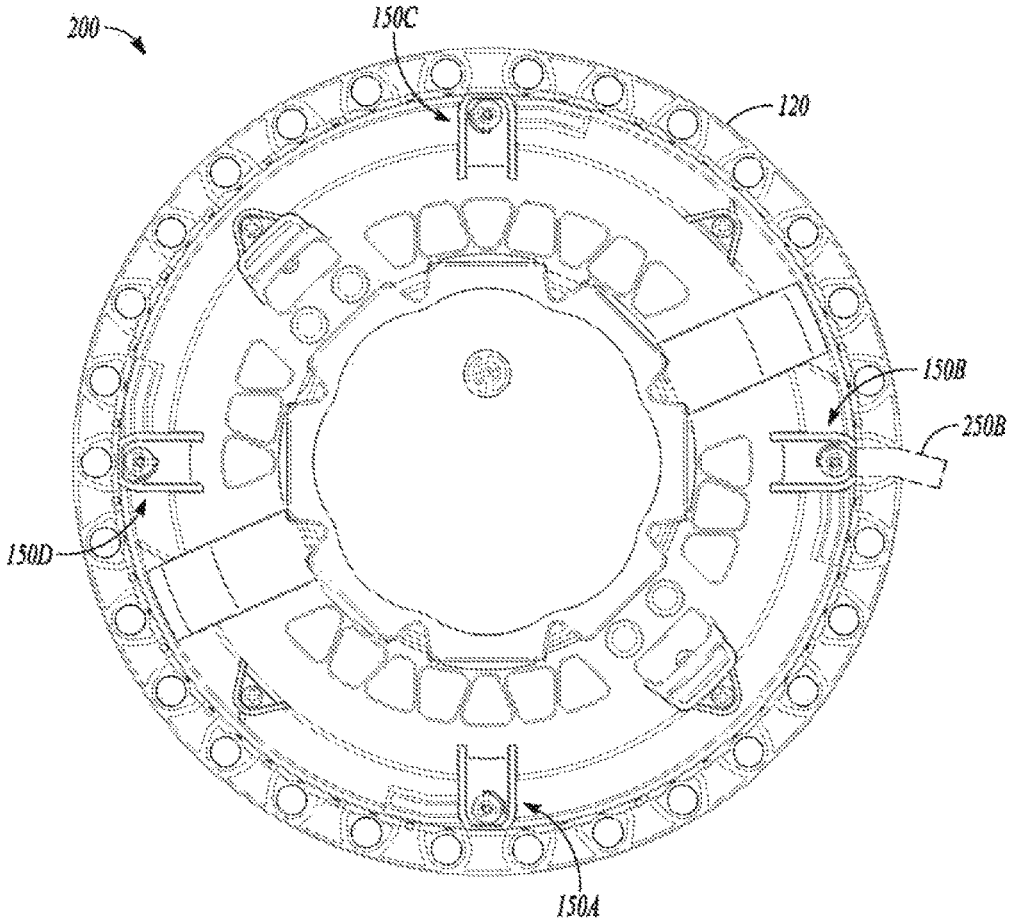
FIG. 2 illustrates generally a rear plan view of a loudspeaker system with a vibration damping assembly.

The first loudspeaker system 100 includes multiple retaining clamp assemblies 150A-150D. One or more of the retaining clamp assemblies 150A-150D can be configured to be deployed against a target mounting surface, such as opposite the flange 120, when the loudspeaker system 100 is installed. In the example of FIG. 1, the retaining clamp assemblies 150A-150D are shown in a deployed position. FIG. 2 illustrates generally a rear view of the loudspeaker system 100 including the retaining clamp assemblies 150A-150D. In the example of FIG. 2, the retaining clamp assemblies 150A-150D are shown in a retracted position. Broken lines at 250B illustrate generally the second retaining clamp assembly 150B rotated to a deployed position.

Referring again to FIG. 1, the retaining clamp assemblies 150A-150D can be actuated using a screw-type mechanism that is accessible from a front side of the loudspeaker system 100, such as after the system is positioned against a mounting surface. For example, the first retaining clamp assembly 150A can be actuated using a first clamp screw 153A, the second retaining clamp assembly 150B can be actuated using a second clamp screw 153B, and so on. In other examples, the screw-type mechanism can be accessible from a rear side of the loudspeaker system, such as for use when the rear side of the system is accessible after the system is positioned at the target mounting surface.

In the example of FIG. 1, the retaining clamp assemblies 150A-150D are illustrated in the deployed position as extending substantially perpendicular to a central axis of the loudspeaker system 100. As shown in the examples of the figures, the retaining clamp assemblies 150A-150D have a bent or arcuate shape. The bent or arcuate shape provides a smaller effective diameter of an in-wall or rear portion of the loudspeaker system 100 when the clamp assemblies are retracted or rotated inward, such as toward a central axis of the loudspeaker system 100. When the retaining clamp assemblies 150A-150D are retracted, the loudspeaker system 100 can be inserted into a speaker cavity. An outer perimeter of the speaker cavity can have a diameter that is less than an outer perimeter of the flange 120 of the loudspeaker system 100, and the outer perimeter diameter of the speaker cavity can be greater than an effective diameter of the loudspeaker system 100 when the clamp assemblies are retracted. In some examples, the loudspeaker system 100 can be inserted into a speaker cavity at an angle. For example, a first portion of the loudspeaker system 100, such as including a first retaining clamp assembly (e.g., 150A) can be inserted into a speaker cavity, and then a second opposite portion of the loudspeaker system 100, such as including a third retaining clamp assembly (e.g., 150C) can be rotated into the cavity. Once the loudspeaker system 100 is positioned within the cavity, it can be centered and then the retaining clamp assemblies can be deployed.

The multiple retaining clamp assemblies 150A-150D of the examples of FIGS. 1 and 2 can each be operated independently. That is, for example, a first retaining clamp assembly 150A can be deployed independently of a second retaining clamp assembly 150B. In other examples, a mechanism can be provided to coordinate deployment of two or more retaining clamp assemblies in concert. Although the loudspeaker system 100 includes four retaining clamp assemblies, fewer or additional retaining clamp assemblies can be used. For example, as few one retaining clamp assembly can be used, such as for a lightweight or small loudspeaker system. Retaining clamp assemblies are further described below.

Referring again to FIG. 1, the first loudspeaker system 100 can be mounted to provide a substantially flush or co-planar surface with respect to a target surface. Among other things, the target surface can be made of drywall, wood, plaster, or any other material that can provide a substantially flat, rigid planar surface. That is, the target mounting surface can include a building structure's structural (e.g., framing studs) or cosmetic (e.g., in-room-facing drywall) elements. In some examples, the flange 120 and the front frame portion 111 are positioned against the target mounting surface in such a manner as to provide a substantially air-tight seal. In some examples, a wall or ceiling cavity can be provided behind the mounted first loudspeaker system 100, such as between wall studs or ceiling trusses. In such examples, the first loudspeaker system 100 can optionally use the cavity to augment a frequency response characteristic of the system. The rear cup portion 112 can optionally be omitted when an in-wall cavity is used to influence a response characteristic of the system 100.

Figure 3:
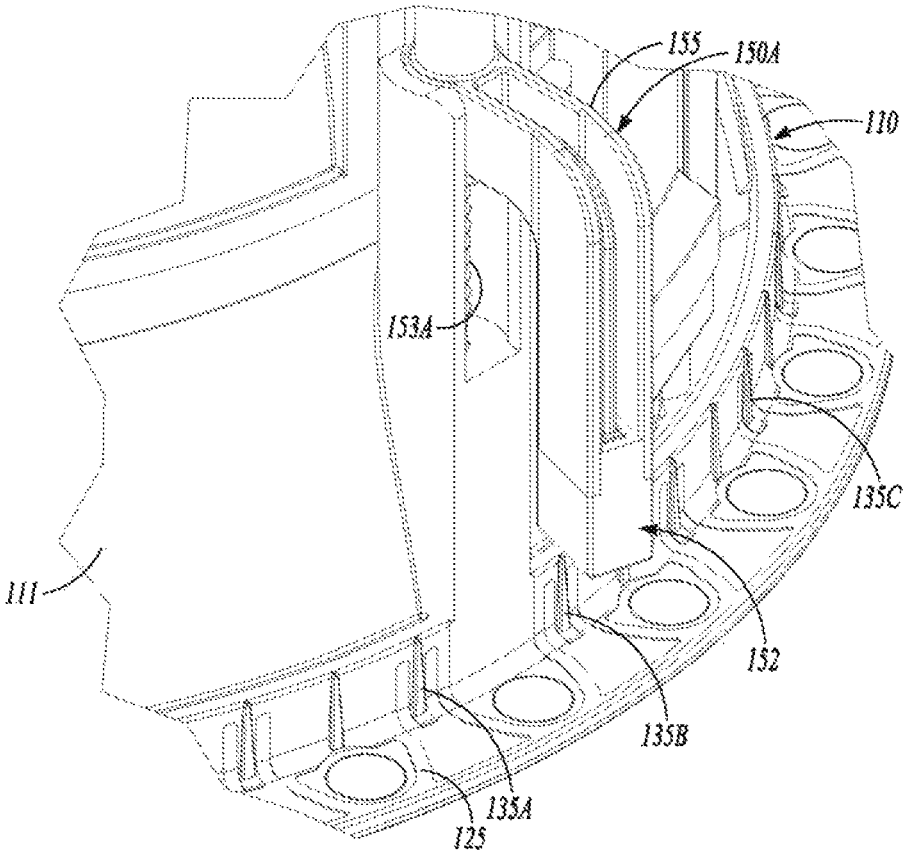
FIG. 3 illustrates generally a detail view of a portion of FIG. 1.
Figure 4:
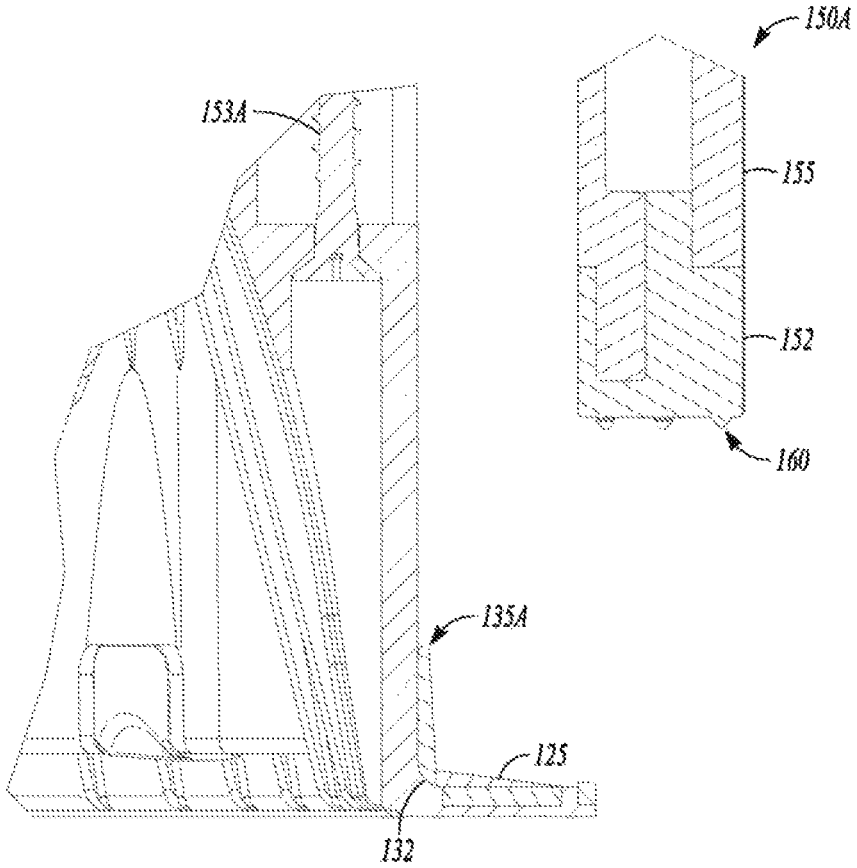
FIG. 4 illustrates generally a section view of a portion of FIG. 3.

FIG. 3 illustrates "detail A" from FIG. 1, including the first retaining clamp assembly 150A. FIG. 4 illustrates generally a section view of a portion of the first retaining clamp assembly 150A and the mounting frame 110. FIGS. 3 and 4 illustrate generally that the first retaining clamp assembly 150A includes a clamp body 155 that can be coupled with the mounting frame 110 and deployed, such as after the first loudspeaker system 100 is positioned in a cavity, to secure the first loudspeaker system 100 to the target surface. The flange 120 has an L-shape for positioning a portion of the flange 120 against the target surface. In an example, deploying a retaining clamp assembly includes one or both of (1) rotating the clamp body 155 away from a central axis of the loudspeaker system 100, such as in a horizontal plane, and (2) translating the clamp body 155, such as in a vertical plane, to secure the clamp assembly against the target surface. In an example, the rotation and translation can be coordinated such that the clamp assembly is simultaneously translated or drawn vertically toward the target surface as the clamp assembly is rotated away from the central axis.

The first retaining clamp assembly 150A includes a clamp damper 152 that can be fixed to or removable from the clamp body 155. In an example, when the first retaining clamp assembly 150A is retracted or at least partially deployed, the clamp damper 152 extends over at least a portion of the flange 120. FIG. 4, for example, illustrates the clamp damper 152 positioned vertically above and vertically overlapping with the flange 120. In an example, when the first retaining clamp assembly 150A is fully deployed, the clamp damper 152 extends beyond the flange 120.

The clamp damper 152 absorbs vibrational or mechanical energy from a loudspeaker driver or transducer (e.g., the woofer assembly 101) and, in an example, converts such energy into heat. The clamp damper 152 can include, or can be formed from, one or more compliant, vibration-damping materials, such as to substantially mechanically isolate the first loudspeaker system 100 from the target mounting surface. For example, the clamp damper 152 can include a low durometer soft rubber, soft or compressible plastic or polymer, fabric, or other rubber-like material to provide compliance between the first loudspeaker system 100 and the target mounting surface. In an example, a vibration damping pad (e.g., including fabric, cloth, felt, rubber, or other compliant material) can be affixed to the clamp damper 152 or can be affixed directly to the clamp body 155, such as in place of the clamp damper 152.

In an example, the first retaining clamp assembly 150A includes one or more springs. A spring can optionally be used in place of the clamp damper 152, or a spring can be interposed between the clamp damper 152 and the clamp body 155. In an example, a spring can be provided at the clamp screw 153A to provide compliance between the first retaining clamp assembly 150A and the mounting frame 110.

In the example of FIG. 4, the clamp damper 152 includes multiple protrusions 160 that extend from a bottom face of the clamp damper 152. The protrusions 160 can be formed integrally with the clamp damper 152 and from the same material as the clamp damper 152, or the protrusions 160 can be formed from a different material. In an example, the protrusions 160 have a different compliance characteristic than the body of the clamp damper 152. That is, the protrusions 160 can be more or less compliant, or compressible, than the body of the clamp damper 152.

FIGS. 3 and 4 illustrate generally perspective and cross section views, respectively, of a flange damper 125 and a first peripheral edge damper 135A. FIG. 3 shows multiple discrete peripheral edge dampers (e.g., at 135B, 135C, etc.) that are positioned at regular intervals about the perimeter of the front frame portion 111 of the mounting frame 110. In other examples, the discrete peripheral edge dampers can be provided as a substantially continuous single member or ring around the perimeter of the front frame portion 111 at the flange 120. The peripheral edge dampers are substantially wedge-shaped compliant members that are positioned at a junction 132 between the front frame portion 111 and the flange 120. The members extend from a thick portion near the junction of the front frame portion 111 and the flange 120, and taper inward along an outer surface of the front frame portion 111 and toward the central axis of the loudspeaker system 100. The peripheral edge dampers can prevent the mounting frame 110 from mechanically touching sides of a cutout hole in a target mounting surface.

In the example of FIGS. 3 and 4, the flange damper 125 is a continuous member that extends over an inner (or upward-facing, as illustrated), surface of the flange 120. In other examples, the flange damper 125 can include multiple discrete damper members positioned on the inner surface of the flange 120. The flange damper 125 is a substantially wedge-shaped, continuous, compliant member, having a thick portion near the junction 132 of the front frame portion 111 and the flange 120, and tapering toward a thin portion near the outer perimeter edge of the flange 120. As shown in the example of FIG. 3, the flange damper 125 is continuous or co-molded with the peripheral edge damper 135A. However, in other examples, the flange damper 125 and one or more of the peripheral edge dampers can be separate members. In an example, the flange damper 125 includes a lattice or patterned series of members having lengths that extend substantially from the junction 132 to or toward the outer perimeter edge of the flange 120. The series of members can enhance the progressive nature of the flange damper 125 as it is compressed, thereby preventing excess vibration transfer.

Although the examples of FIGS. 1-4 illustrate generally systems that include multiple mechanical damping features, such as the clamp damper 152, the flange damper 125, and the peripheral edge damper 135A, any one or more of these damping features can be used independently or together in a particular assembly. To further influence a damping characteristic of a loudspeaker system, one or more of the flange damper 125, the first peripheral edge damper 135A, and the clamp damper 152, can include a ribbed, corrugated, or perforated surface.

FIG. 5 illustrates generally an isometric section view of a portion of the loudspeaker system 100. The illustrated portion includes the clamp body 155 of the first retaining clamp assembly 150A, the first clamp screw 153A, a damping adjustment port 501 in the front frame portion 111 of the mounting frame 110, and a threaded receptacle 502 coupled to the clamp body 155. The first clamp screw 153A is received in the threaded receptacle 502, and is user-adjustable from the front side of the loudspeaker system 100 by way of the damping adjustment port 501.

In the example of FIG. 5, when the first clamp screw 153A is turned, the first retaining clamp assembly 150A, including the clamp body 155, is rotated away from the retracted position. The front frame portion 111 includes an integrated stop 511 that inhibits rotation of the first retaining clamp assembly 150A beyond a specified maximum rotated position. Although the stop 511 is integrated with the front frame portion 111, a similar stop could be additionally or alternatively provided as integrated with the first retaining clamp assembly 150A, as a separate portion of the loudspeaker system, or the stop could be omitted. With the clamp body 155 of the first retaining clamp assembly 150A in a partially deployed and rotated configuration, as shown in FIG. 5, further adjustment of the first clamp screw 153A causes the first retaining clamp assembly 150A to translate vertically. That is, if the first clamp screw 153A is further driven into the threaded receptacle 502 in the example of FIG. 2, then the first retaining clamp assembly 150A will be responsively driven downward toward the flange 120.

FIG. 6 illustrates generally an example of an isometric section view of the loudspeaker system 100 installed at a mounting surface 600. The mounting surface 600 includes a cutout having an edge 610 that corresponds to the outer perimeter of the loudspeaker system 100. As described above, any one or more of the several mechanical damping features, such as including the clamp damper 152, the flange damper 125, and the peripheral edge damper 135A, are configured to be placed in surface contact with at least a portion of a target mounting surface, such as the mounting surface 600. In the example of FIG. 6, the flange damper 125 contacts an outer surface (e.g., a room-facing or exterior surface) of the mounting surface 600, the peripheral edge damper 135A contacts an inner edge of the cutout in the mounting surface 600, and the clamp damper 152 is positioned above an inner surface (e.g., a stud-facing or interior surface) of the mounting surface 600.

In an example, a size of the cutout in the mounting surface 600 influences a damping characteristic. That is, the size of the cutout can, at least in part, influence how much isolation or mechanical damping is provided between the loudspeaker system 100 and the mounting surface 600. For example, if the cutout diameter exceeds the diameter of loudspeaker system 100 at the junction 132, then one or more of the compressible, wedge-shaped peripheral edge dampers, including the first peripheral edge damper 135A, may not be compressed when the loudspeaker system 100 is installed in the mounting surface 600.

In an example, a vertical position (with respect to the orientation of the example of FIG. 6) of the first retaining clamp assembly 150A influences a damping characteristic. The vertical position of the first retaining clamp assembly 150A is adjustable using the first clamp screw 153A. Thus, the tightness of fit or compression of at least one or both of the clamp damper 152 and the flange damper 125 are influenced by the position of the first clamp screw 153A relative to the clamp body 155 and the threaded receptacle 502. As the first clamp screw 153A is driven into the threaded receptacle 502, the clamp damper 152 impinges on and is compressed against the mounting surface 600. Similarly, the flange damper 125 impinges on and is compressed against an opposite side of the mounting surface 600. In an example, the clamp damper 152 and the flange damper 125 comprise different durometer materials such that one of the clamp damper 152 and the flange damper 125 compresses or deforms at a different rate than the other.

In an example, the tightness of fit or compression of the peripheral edge damper 135A is similarly influenced by the position of the first clamp screw 153A, such as depending on the size of the cutout in the mounting surface 600. If the cutout has a smaller diameter than the diameter of the loudspeaker system 100 at the junction 132, then the flange 120 of the loudspeaker system 100 may not fully seat against the outer surface of the mounting surface 600. Instead, an outer edge of the mounting surface 600 would impinge on the peripheral edge dampers of the assembly. In an example, however, the peripheral edge dampers can be compressed to bring the flange 120 into contact with the mounting surface 600. When the first clamp screw 153A is driven into the threaded receptacle 502, the force exerted on the mounting surface 600 can compress the peripheral edge dampers and thus drive the flange 120 toward the outer surface of the mounting surface 600. In some examples, the peripheral edge dampers can be used in coordination with the clamp damping assemblies to adjust a position or center of the loudspeaker system 100 with respect to the cutout in the surface 600.

Figure 7:
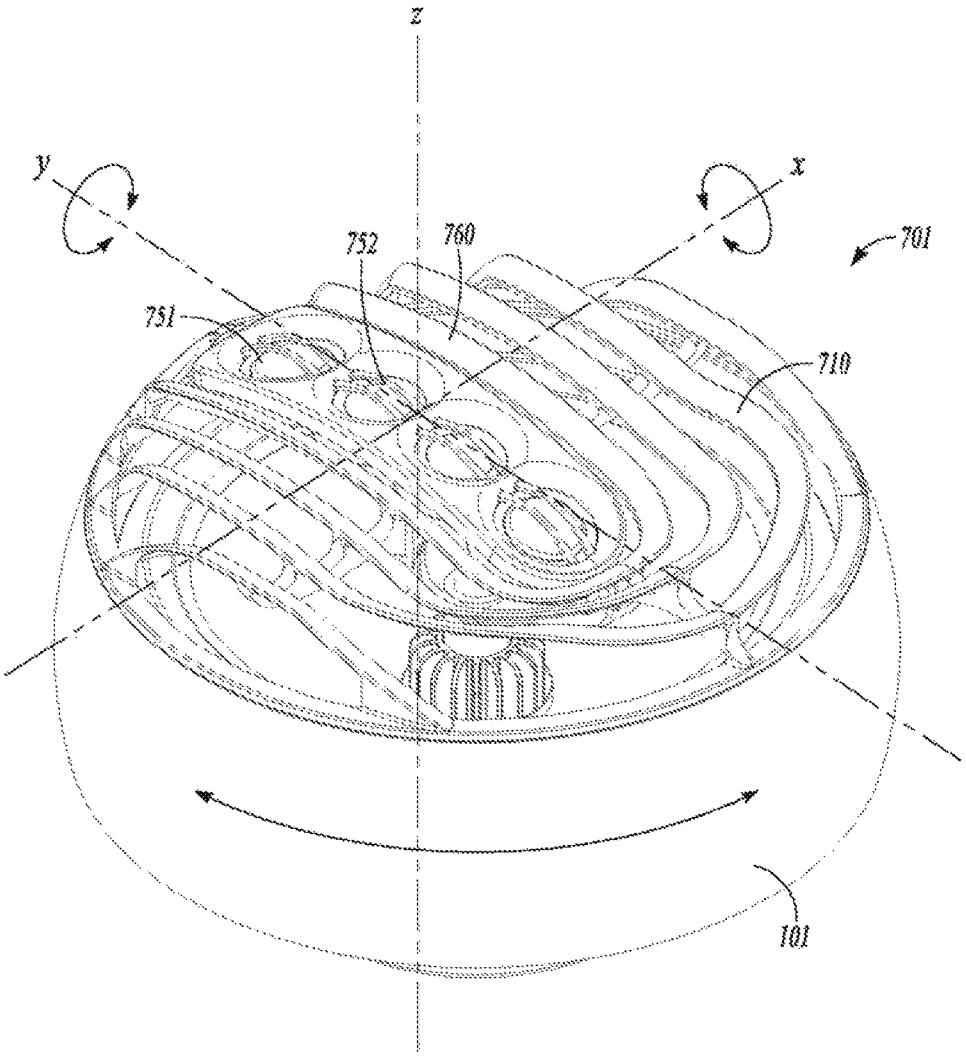
FIG. 7 illustrates generally an isometric view of a loudspeaker system that includes multiple high frequency transducers.

Referring now to FIG. 7, an isometric view shows that a portion of the loudspeaker system 100 includes a driver assembly 701. In the example of FIG. 7, the front frame portion 111 of the mounting frame 110 is omitted for clarity of the illustration. The driver assembly 701 includes the woofer assembly 101 and one or more high frequency transducers. For example, the driver assembly 701 can include at least a first high frequency transducer 751. The loudspeaker system 100 can include, or can be coupled with, a crossover network that provides low frequency signal information to the woofer assembly 101 and that provides high frequency signal information to at least the first high frequency transducer 751. The example of FIG. 7 can further include a waveguide assembly 710. The waveguide assembly 710 can have a curved, flat, or undulating profile. The waveguide assembly 710 protects the underlying transducer(s), and the waveguide assembly 710 can be configured to influence a frequency response or signal dispersion characteristic of the loudspeaker system 100. In an example, the waveguide assembly 710 is removable and it mates with the loudspeaker system 100 using magnets or other detachable means. In an example, a grille assembly can be provided in addition to the waveguide assembly 710, such as overlying the waveguide assembly 710 to provide a uniform or flat appearance to the installed system.

The driver assembly 701 can include an array 760 of multiple high frequency transducers. In the example of FIG. 7, the array 760 includes multiple transducers that are arranged substantially along an arcuate path. In other examples, the array 760 can include the multiple transducers substantially arranged in a single plane.

In the example of FIG. 7, the transducers positioned along the arcuate path can be positioned at least partially over the cone of the woofer assembly 101. When the multiple high frequency transducers are so arranged along an arcuate path in the loudspeaker system 100, and when the loudspeaker system is installed flush with a ceiling, wall, or other mounting surface, the loudspeaker system 100 is configured to provide a listener with an enhanced perception of the "width" or "spaciousness" of sound reproduced by the system.

In the example of FIG. 7, the array 760 includes four high frequency transducers. Any two or more of the high frequency transducers in the array 760 can be configured similarly, such as for reproducing the same or similar audio frequency band(s), or any one of the high frequency transducers in the array 760 can be configured differently than the others, such as for reproducing a different audio frequency band than the others. In an example, each of the transducers in the array 760 can have a separate audio signal input, such as at the rear of the loudspeaker system 100.

The array 760, or the transducers included in the array 760, can have a position or orientation that is adjustable by an installer or user. User-adjustability can be important to conform an installed loudspeaker system to a particular environment or to suit a particular listener's preferences. In an example, any one or more of the high frequency transducers in the array 760 can be separately positioned or aimed with respect to the array 760 and the other transducers. For example, the first high frequency transducer 751 can be pivoted, tilted, or swiveled in a first direction (e.g., panned left) and a second high frequency transducer 752 can be tilted or swiveled in a second direction (e.g., panned right). Systems for providing a transducer capable of being swiveled are provided in Burdett et al., U.S. Pat. No. 6,070,694, titled "Loudspeaker Assembly", which is hereby incorporated herein by reference in its entirety. In an example, the woofer assembly 101 includes a low frequency transducer that is similarly configured to pivot, tilt, or swivel.

Figure 8:
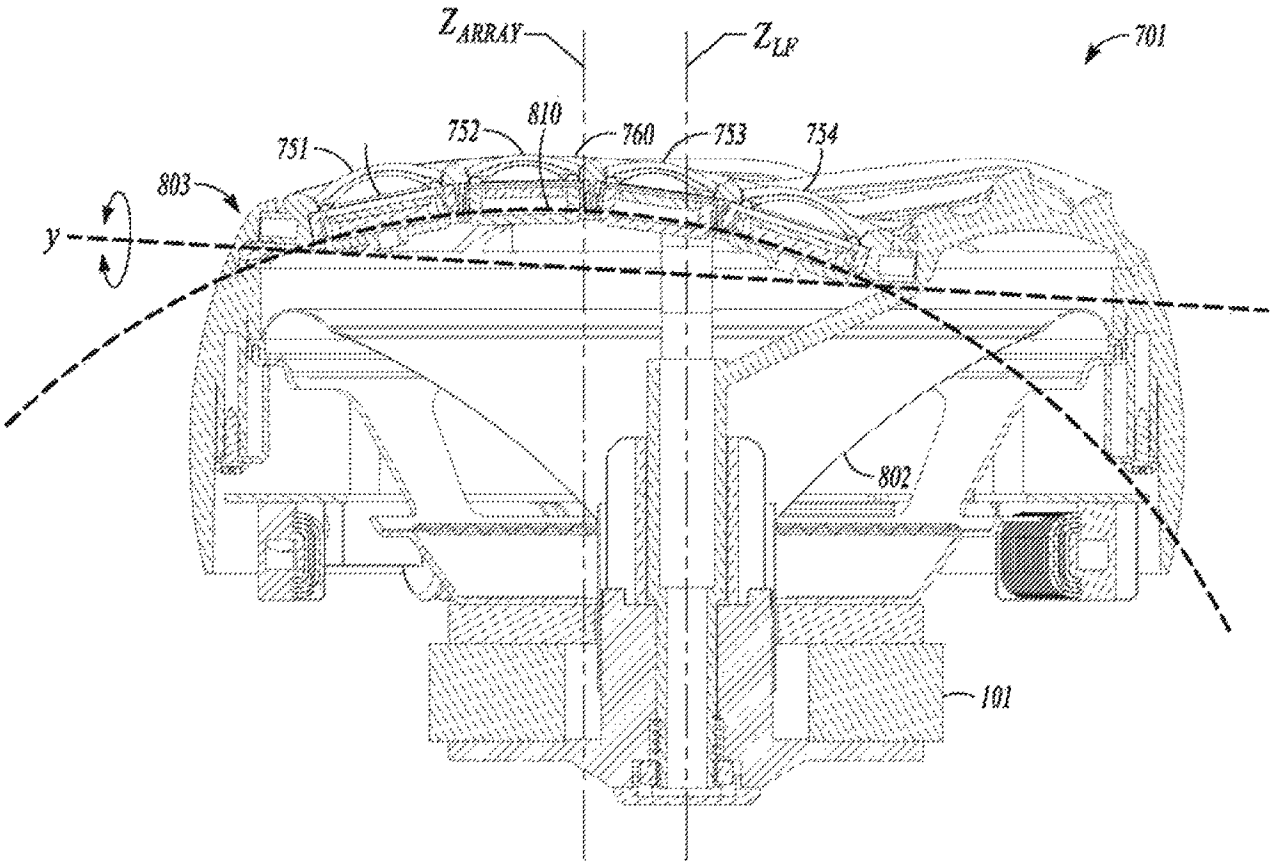
FIG. 8 illustrates generally a section view of a loudspeaker system that includes a low frequency transducer and multiple high frequency transducers arranged along an arcuate path.

In an example, the array 760 can be rotatable in one or more axes, such as illustrated in the example of FIG. 7 with respect to the x, y, and z axes. That is, the array 760 including the multiple high frequency transducers can rotate as a unit in one or more axes. In an example, the array 760 can rotate about the x axis. When the array 760 is rotated about the x axis, the first high frequency transducer 751 is translated toward or away from the woofer assembly 101. In an example, the array 760 can rotate about the y axis, such as corresponding to a longitudinal axis of the array 760. When the array 760 is rotated about the y axis, each of the multiple high frequency transducers is similarly panned, such as between left/right or up/down orientations. FIG. 8 illustrates generally a second view of the array 760 with respect to the y axis. In an example, the array 760 can rotate about the z axis. The array 760 can be configured to rotate about the z axis independently of, or together with, the waveguide assembly 710. The z axis of the array 760 can be coaxial with a central axis of the loudspeaker system 100, or the z axis can be offset from the central axis of the loudspeaker system 100, such as shown in the example of FIG. 7. In an example, the array 760 can rotate 360 degrees about the central axis of the loudspeaker system 100, thereby providing a user-variable high frequency output pattern to suit multiple different applications. For example, high frequency dispersion characteristics can be tailored for different coverage of an environment, such as in a horizontal or vertical plane depending on an orientation of the array 760 relative to the environment.

Vertical directivity of the loudspeaker system 100 is enhanced when two or more of the high frequency transducers in the array 760 are arranged along an arc that overlaps with, or is positioned substantially in front of, the cone of the woofer assembly 101. That is, instead of positioning multiple transducers in a single plane over the woofer assembly 101, the central axes of each of the high frequency transducers in the array 760 can be nonparallel. (The array 760 can itself have a central axis, about which the array 760 can be configured to rotate, as described above.) In some examples, each of the three (or more) central axes defined respectively by the woofer assembly 101 and the two (or more) high frequency transducers in the array 760 can be non-coaxial or nonparallel. A central axis of the array 760 can be further non-coaxial or nonparallel with central axis of the woofer assembly 101 and the respective central axes of the high frequency transducers in the array 760. By orienting or positioning the multiple high frequency transducers sufficiently close together and along an arc to provide the array 760, interference between acoustic signals respectively reproduced by the transducers can be minimized.

FIG. 8 illustrates generally a cross section of the portion of the loudspeaker system 100 from FIG. 7. The example of FIG. 8 shows the array 760 of high frequency transducers and the woofer assembly 101. The woofer assembly 101 includes, among other components, a cone 802 and a woofer frame 803. In the examples of FIGS. 7 and 8, the array 760 includes first, second, third, and fourth high frequency transducers 751, 752, 753, and 754. Although the examples illustrate four high frequency transducers in the array 760, any array that includes two or more transducers can be used. Generally, the high frequency transducer array 760 can include two or more transducers that are configured to reproduce frequencies at or above a low-pass cutoff frequency of the woofer assembly 101.

The first through fourth high frequency transducers 751-754 in the array 760 are arranged along an arcuate path 810. The first and fourth high frequency transducers 751 and 754 correspond to opposite ends of the arcuate path 810. The arcuate path 810 of the array 760 has a central axis that corresponds to $Z_{ARRAY}$ in the example of FIG. 8. The central axis $Z_{ARRAY}$ is considered to be an axis that extends through a center of the array 760 and through a center of a circle that includes the arcuate path 810 along which the first through fourth high frequency transducers 751-754 are arranged. The center of the array 760 is considered to be at a midpoint of the arcuate path 810, such as corresponding to a center of a segment that connects the opposite ends of the arcuate path 810. In the example of FIG. 8, the center of the array 760 is located between the second and third high frequency transducers 752 and 753.

The low frequency transducer, or woofer assembly 101, has a central axis that corresponds to $Z_{LF}$. As described above in the discussion of FIG. 7, each of the high frequency transducers 751-754 can have a respective different and non-parallel central axis that is non-coaxial with either of $Z_{ARRAY}$ or $Z_{LF}$. In other examples, a central axis of at least one of the high frequency transducers 751-754 is configured to be coaxial or parallel to $Z_{LF}$. The position of each of the individual high frequency transducers 751-754 along the arcuate path 810 can be specified to minimize signal-degrading proximity effects between the different transducers, such as in at least one sound-projecting direction.

In an example, the array 760 is offset or biased to one side edge of the woofer assembly 101. For example, as shown in FIGS. 7 and 8, the first high frequency transducer 751 is positioned near a flange or frame edge of the woofer assembly, and the fourth high frequency transducer 754 is positioned relatively near the central axis $Z_{LF}$ of the woofer assembly 101.

In an example, adverse dispersion characteristics or distortion can occur when a high frequency transducer is positioned below or behind a mounting surface plane of the loudspeaker system 100. To minimize these effects, the loudspeaker system 100 includes the array 760 positioned in relatively close proximity to an edge of the front frame portion 111 of the mounting frame 110 (see, e.g., FIG. 1). The outer-most or first high frequency transducer 751 is positioned as closely as possible to the flange 120 portion of the mounting frame 110. When the outer-most or first high frequency transducer 751 is so positioned, dispersion is improved and distortion is minimized.

In an example that includes at least three high frequency transducers in an array that overlaps with and is in close proximity to a low frequency transducer, the high frequency transducers in the array are arranged along the arcuate path 810 such that one or more of the middle or center transducers protrudes above the other transducers, and the locations of other transducers progressively recede downward or rearward along opposite sides of the arc. In an example, the transducers in a high frequency transducer array can be arranged in a non-arcuate line array (i.e., in a co-planar manner) wherein an outer-most high frequency transducer is positioned as closely as possible to the flange of the loudspeaker, as described above. In other examples, the high frequency transducer orientation is mixed, including at least two of the transducers arranged along a partial arcuate path, while one or more other transducers are arranged substantially linearly.

The loudspeaker system 100 can include a crossover network to direct different audio frequency signal bands to the multiple transducers in the system. For example, second-order Butterworth or asymmetrical second or third-order topologies can be used. In an example, a crossover network for the loudspeaker system 100 can include an asymmetrical crossover slope such that a woofer or low-pass slope is more shallow (i.e., relatively fewer dB per octave of attenuation) than a tweeter or high-pass slope. In an example, a single high-pass filter can serve each of the transducers in the array 760, or any one or more of the high frequency transducers in the array can have a dedicated filter.

The relationship between the low and high-pass filter slopes can be selected to compensate for inter-driver time delays. Such time delays can be a result of the different positions of the multiple drivers or voice coils with respect to a listening point in the soundfield. For example, because the array 760 is positioned in front of the woofer assembly 101, a time delay with respect to the listening point can exist between acoustic signals reproduced by the high frequency transducers in the array 760 and acoustic signals reproduced by the low frequency transducer in the woofer assembly 101. By adjusting the relationship between the low and high-pass filter slopes, such as by providing a greater slope high-pass filter for the array 760 (e.g., 12 dB per octave) and a lesser slope low-pass filter for the woofer assembly 101 (e.g., 6 dB per octave), a more "musical" blend can be provided to listeners located at or near the listening point in the soundfield.

VARIOUS NOTES

Example 1 can include or use subject matter such as an assembly that includes, or is configured for use with, a loudspeaker transducer. The assembly of Example 1 can be configured for attenuating acoustic vibration transmitted from a loudspeaker transducer to a loudspeaker mounting surface. Example 1 can include or use a loudspeaker mounting frame including a body portion that is configured to receive a loudspeaker transducer, a substantially open front face with a perimeter edge, and a flange extending laterally outward from the perimeter edge. The flange can include a room-facing side and an opposite transducer-facing side, wherein the transducer-facing side contacts an outer surface of the loudspeaker mounting surface when the loudspeaker mounting assembly is installed at the loudspeaker mounting surface. Example 1 can further include a damping assembly, including a clamp damper that extends from the body portion of the mounting frame and is configured to impinge on an inner surface of the loudspeaker mounting surface (e.g., an inside surface or stud-facing surface of a wall, or an inside wall of a cabinet) that is substantially opposite the flange, such as when the flange is positioned against an outer surface of the loudspeaker mounting surface (e.g., an outside surface or room-facing surface of a wall, or an outside wall of a cabinet).

Example 2 can include, or can optionally be combined with the subject matter of Example 1, to optionally include an arm as a portion of the clamp damper, wherein the arm is rotatable between retracted and deployed positions. In Example 2, in the retracted position, the loudspeaker mounting assembly is configured to be inserted into the loudspeaker mounting surface and the loudspeaker mounting assembly has a minimum installation diameter. In Example 2, in the deployed position, the arm extends substantially laterally away from a central axis of the loudspeaker mounting frame.

Example 3 can include, or can optionally be combined with the subject matter of Example 2, to optionally include a clamp screw accessible to a user at or near the open front face of the loudspeaker mounting frame, wherein in the deployed position, the clamp damper is translated toward or away from the flange in response to rotation of the clamp screw.

Example 4 can include, or can optionally be combined with the subject matter of one or any combination of Examples 2 or 3 to optionally include the arm of the clamp damper with an arcuate profile such that, in the retracted position, the arm of the clamp damper conforms to (e.g., wraps around or follows) a corresponding arcuate profile of the body portion of the loudspeaker mounting frame.

Example 5 can include, or can optionally be combined with the subject matter of one or any combination of Examples 2 through 4 to optionally include, with the clamp damper, a compressible and compliant damper material positioned at an end of the arm nearest to the flange.

Example 6 can include, or can optionally be combined with the subject matter of Example 5, to optionally include the compressible and compliant damper material is changeable by a user to include other compressible and compliant damper materials to provide different acoustic vibration attenuation characteristics.

Example 7 can include, or can optionally be combined with the subject matter of one or any combination of Examples 2 through 6 to optionally include one or more deformable protrusions that extend from the end of the arm nearest to the flange.

Example 8 can include, or can optionally be combined with the subject matter of Example 1, to optionally include, in the damping assembly, at least one of (1) a flange damper on the transducer-facing side of the flange, the flange damper extending laterally or radially outward from a location at or near the perimeter edge of the open front face, and (2) a peripheral edge damper extending from near the perimeter edge along an outer-facing surface of the body portion of the loudspeaker mounting frame and extending away from the flange.

Example 9 can include, or can optionally be combined with the subject matter of Example 8, to optionally include the flange damper, wherein the flange damper includes a lattice of compressible damping material that extends over a portion of the transducer-facing side of the flange.

Example 10 can include, or can optionally be combined with the subject matter of one or any combination of Examples 8 or 9 to optionally include the flange damper, wherein the flange damper is substantially wedge shaped, and wherein the flange damper includes a thicker portion near the perimeter edge of the open front face and the flange damper tapers toward an outer edge of the flange.

Example 11 can include, or can optionally be combined with the subject matter of Example 1, to optionally include a flange damper on the transducer-facing side of the flange, the flange damper extending laterally outward from a location at or near the perimeter edge of the open front face, and a peripheral edge damper extending from near the perimeter edge along an outer-facing surface of the body portion of the loudspeaker mounting frame and extending away from the flange.

Example 12 can include, or can optionally be combined with the subject matter of Example 11, to optionally include the flange damper and the peripheral edge damper integrally molded together. That is, the flange damper and the peripheral edge damper can be molded together, such as in a single molding process, to provide a unitary damper that includes portions on the flange and portions at a lateral side edge of the housing.

Example 13 can include, or can optionally be combined with the subject matter of one or any combination of Examples 11 or 12 to optionally include the peripheral edge damper is substantially wedge shaped, and the peripheral edge damper includes a thicker portion near the perimeter edge and the peripheral edge damper tapers away from the flange.

Example 14 can include, or can optionally be combined with the subject matter of one or any combination of Examples 11 through 13 to optionally include, in at least one of the flange damper, the peripheral edge damper, and the clamp damper, a compressible and compliant damper material that is different than a compressible and compliant damper material used in the others of the flange damper, the peripheral edge damper, and the clamp damper.

Example 15 can include, or can optionally be combined with the subject matter of one or any combination of Examples 11 through 13 to optionally include the flange damper, the peripheral edge damper, and the clamp damper formed from the same type of compressible and compliant damper material.

Example 16 can include, or can optionally be combined with the subject matter of Example 1 to optionally include, in the damping assembly, a peripheral edge damper extending from near the perimeter edge along an outer-facing surface of the body portion of the loudspeaker mounting frame and extending away from the flange, and wherein the peripheral edge damper is configured to be located between the body portion of the loudspeaker mounting frame and a cutout edge surface of the loudspeaker mounting surface.

Example 17 can include, or can optionally be combined with the subject matter of Example 16 to optionally include the peripheral edge damper is substantially wedge shaped, and the peripheral edge damper includes a thicker portion near the perimeter edge and the peripheral edge damper tapers away from the flange.

Example 18 can include, or can optionally be combined with the subject matter of one or any combination of Examples 16 or 17 to optionally include, as the peripheral edge damper, multiple discrete peripheral edge damper members that are positioned at substantially regular intervals about an outer-facing surface of the body portion of the mounting frame.

Example 19 can include or use subject matter such as an assembly that includes, or is configured for use with, a loudspeaker transducer. The assembly of Example 19 can be configured for attenuating acoustic vibration transmitted from a loudspeaker transducer to a loudspeaker mounting surface. Example 19 can include or use a loudspeaker mounting frame including a body portion that is configured to receive a loudspeaker transducer, a substantially open front face with a perimeter edge, and a flange extending substantially radially outward from the perimeter edge. In Example 19, the flange can include a room-facing side and an opposite transducer-facing side, wherein the transducer-facing side contacts an outer surface of the loudspeaker mounting surface when the loudspeaker mounting assembly is installed at the loudspeaker mounting surface. Example 19 can further include a damping assembly with a flange damper, a peripheral edge damper, and an adjustable clamp damper. The flange damper can be provided on the transducer-facing side of the flange, and the flange damper can be substantially wedge-shaped and tapered radially outward from the perimeter edge of the open front face. The flange damper can be configured to contact the outer surface of the loudspeaker mounting surface. The peripheral edge damper can extend from near the perimeter edge along an outer-facing surface of the body portion of the loudspeaker mounting frame and taper away from the flange. The peripheral edge damper can be configured to contact a cutout edge surface of the loudspeaker mounting surface. The adjustable clamp damper can extend from the body portion of the mounting frame and contact an inner surface of the loudspeaker mounting surface. The adjustable clamp damper can be configured to secure the loudspeaker mounting assembly to the loudspeaker mounting surface according to user-rotation of a clamp screw that is coupled to the adjustable clamp damper.

Example 20 can include or use subject matter such as a loudspeaker having multiple transducers. The loudspeaker of Example 20 can include at least a low frequency first transducer including a first diaphragm defining a first central axis, and the first transducer can have a front sound-projecting face. Example 20 can include a high frequency transducer array with at least first and second high frequency transducers arranged along an arcuate path. The array defines a second central axis that extends through a center of the array and through a center of a circle that includes the arcuate path. The high frequency transducer array overlaps with at least a portion of the front sound-projecting face of the first transducer, and, in an example, the first and second central axes are non-coaxial.

Example 21 can include, or can optionally be combined with the subject matter of Example 20, to optionally include the high frequency transducer array rotatable about the first central axis corresponding to the low frequency first transducer.

Example 22 can include, or can optionally be combined with the subject matter of one or any combination of Examples 20 or 21 to optionally include the high frequency transducer array rotatable about an axis that substantially corresponds to a segment connecting the endpoints of the arcuate path.

Example 23 can include, or can optionally be combined with the subject matter of one or any combination of Examples 20 through 22 to optionally include the first diaphragm of the low frequency first transducer with an outermost perimeter edge, and wherein one of the first and second high frequency transducers is located more proximal to the outermost perimeter edge of the first diaphragm than the other of the first and second high frequency transducers.

Example 24 can include, or can optionally be combined with the subject matter of one or any combination of Examples 20 through 23 to optionally include the high frequency transducer array overlaps with the first central axis defined by the first diaphragm of the low frequency first transducer.

Example 25 can include, or can optionally be combined with the subject matter of one or any combination of Examples 20 through 24 to optionally include the high frequency transducer array having at least third and fourth high frequency transducers arranged along the same arcuate path.

Example 26 can include, or can optionally be combined with the subject matter of Example 20, to optionally include each of the first, second, third, and fourth high frequency transducers in the high frequency transducer array substantially overlapping with the front sound-projecting face of the first transducer.

Example 27 can include, or can optionally be combined with the subject matter of one or any combination of Examples 20 through 26 to optionally include the high frequency transducer array is rotatable about an axis that is substantially orthogonal to a segment connecting the endpoints of the arcuate path.

Example 28 can include, or can optionally be combined with the subject matter of one or any combination of Examples 20 through 27 to optionally include at least one of the first and second high frequency transducers in the high frequency transducer array is configured to pivot with respect to the array. In an example, the array itself is configured to pivot with respect to the low frequency transducer.

Example 29 can include, or can optionally be combined with the subject matter of one or any combination of Examples 20 through 28 to optionally include the high frequency transducer array substantially rotatable about three axes. For example, the three axes can include a first axis corresponding to the first central axis of the low frequency first transducer, a second axis corresponding to a segment connecting the endpoints of the arcuate path, and a third axis that is substantially orthogonal to the second axis.

Example 30 can include, or can optionally be combined with the subject matter of one or any combination of Examples 20 through 29 to optionally include a waveguide assembly that is configured to substantially cover the front sound-projecting face of the low frequency first transducer, wherein the waveguide assembly includes an undulating profile that, at least in part, conforms to the arcuate path in a portion of the waveguide assembly that includes the high frequency transducer array.

Example 31 can include, or can optionally be combined with the subject matter of one or any combination of Examples 20 through 30 to optionally include a loudspeaker frame, wherein the low frequency first transducer is configured to pivot with respect to the loudspeaker frame, and wherein the high frequency transducer array is configured to be rotatable in at least two axes (or pivotable) with respect to the loudspeaker frame.

Example 32 can include, or can optionally be combined with the subject matter of one or any combination of Examples 20 through 31 to optionally include an audio signal crossover network including a low-pass filter configured to receive an audio input signal and provide a first filtered audio signal to the low frequency first transducer, wherein the low-pass filter has a first slope, and a high-pass filter configured to receive the audio input signal and provide a second filtered audio signal to at least one of the first and second high frequency transducers in the high frequency transducer array, wherein the high-pass filter has a second slope that is greater than the first slope.

In an example, any of the multiple-transducer loudspeaker examples, such as corresponding to Examples 20 through 32, can be configured for use together with any of the loudspeaker mounting assemblies described in Examples 1-19. Each of the non-limiting Examples 1 through 32 can stand on its own, or can be combined in various pei mutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A loudspeaker system comprising:

a low frequency first transducer including a first diaphragm defining a first central axis, the first transducer having a front sound-projecting face; and a high frequency transducer array including at least first and second high frequency transducers arranged along an arcuate path, the array defining a second central axis that extends through the array and through a center of a circle that includes the arcuate path;

wherein the high frequency transducer array overlaps with at least a portion of the front sound-projecting face of the first transducer, and the high frequency transducer array is rotatable as a unit about an axis that substantially corresponds to a segment connecting endpoints of the arcuate path; and wherein the first and second central axes are non-coaxial.

2. The loudspeaker system of claim 1, wherein the high frequency transducer array is rotatable about the first central axis corresponding to the low frequency first transducer.

3. The loudspeaker system of claim 1, wherein the first diaphragm of the low frequency first transducer has an outermost perimeter edge, and wherein one of the first and second high frequency transducers is located more proximal to the outermost perimeter edge of the first diaphragm than the other of the first and second high frequency transducers.

4. The loudspeaker system of claim 1, wherein the high frequency transducer array overlaps with the first central axis defined by the first diaphragm of the low frequency first transducer.

5. The loudspeaker system of claim 1, wherein the high frequency transducer array further includes third and fourth high frequency transducers arranged along the arcuate path.

6. The loudspeaker system of claim 5, wherein each of the first, second, third, and fourth high frequency transducers in the high frequency transducer array overlaps with the front sound-projecting face of the first transducer.

7. The loudspeaker system of claim 1, wherein the high frequency transducer array is rotatable about an axis that is substantially orthogonal to a segment connecting the endpoints of the arcuate path.

8. The loudspeaker system of claim 1, wherein at least one of the first and second high frequency transducers in the high frequency transducer array is configured to pivot with respect to the array.

9. The loudspeaker system of claim 1, wherein the high frequency transducer array is rotatable about three axes, including:

a first axis corresponding to the first central axis of the low frequency first transducer;

a second axis corresponding to a segment connecting the endpoints of the arcuate path; and a third axis that is substantially orthogonal to the second axis.

10. The loudspeaker system of claim 1, further comprising a waveguide assembly that is configured to substantially cover the front sound-projecting face of the low frequency first transducer, wherein the waveguide assembly includes an undulating profile that, at least in part, conforms to the arcuate path in a portion of the waveguide assembly that includes the high frequency transducer array.

11. The loudspeaker system of claim 1, further comprising a loudspeaker frame, wherein the low frequency first transducer is configured to pivot with respect to the loudspeaker frame, and wherein the high frequency transducer array is rotatable about at least two axes with respect to the loudspeaker frame.

12. A loudspeaker array assembly comprising:

a first high-frequency loudspeaker driver;

a second high-frequency loudspeaker driver; and a loudspeaker driver mounting structure coupled to a third loudspeaker driver assembly and extending over a sound-projecting face of the third driver, wherein the mounting structure is configured to hold the first and second drivers at different locations along a first path, and wherein a central axis of the third driver is offset from a central axis of the first path, and wherein the mounting structure configured to hold the first and second drivers is rotatable about an axis that substantially corresponds to a segment connecting endpoints of the first path.

13. The assembly of claim 12, wherein the mounting structure is rotatable about the central axis of the third driver.

14. The assembly of claim 12, wherein the mounting structure is rotatable about an axis transverse to the arcuate path.

15. The assembly of claim 12, wherein the mounting structure comprises a rotatable portion of a waveguide assembly that overlays the sound-projecting face of the third driver, wherein the waveguide assembly includes an undulating profile that, at least in part, conforms to the first path.

16. A multiple-driver loudspeaker frame comprising:

a first loudspeaker mount configured to receive a low-frequency first loudspeaker driver having a first central axis;

a second loudspeaker mount configured to receive at least two high-frequency loudspeaker drivers, wherein the second loudspeaker mount includes an arcuate portion that extends over at least a portion of a sound-projecting front face of the first loudspeaker driver, and wherein the second mount has a second central axis; and a waveguide assembly configured to substantially cover a front sound-projecting face of the first loudspeaker driver, wherein the waveguide assembly includes an undulating profile that, at least in part, conforms to the arcuate portion of the second loudspeaker mount;

wherein the first and second central axes are non-coaxial.

17. The multiple-driver loudspeaker frame of claim 16, wherein the first and second central axes are non-parallel.

18. The multiple-driver loudspeaker frame of claim 16, wherein the second loudspeaker mount is rotatable with the respect to the first loudspeaker mount.

19. The multiple-driver loudspeaker frame of claim 18, wherein the second loudspeaker mount defines a longitudinal axis in its length direction, and wherein the second loudspeaker mount is rotatable about the longitudinal axis.

20. The assembly of claim 12, wherein the first path is an arcuate path.

* * * * *